US007364328B2

(12) United States Patent
Lee et al.

(10) Patent No.: US 7,364,328 B2
(45) Date of Patent: Apr. 29, 2008

(54) OPEN/SHUT STRUCTURE FOR STREET LAMP WITH PLASMA LIGHTING SYSTEM

(75) Inventors: Seok-Yeong Lee, Gyeonggi-Do (KR); Yong-Seog Jeon, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 67 days.

(21) Appl. No.: 11/331,029

(22) Filed: Jan. 13, 2006

(65) Prior Publication Data

US 2006/0203500 A1 Sep. 14, 2006

(30) Foreign Application Priority Data

Mar. 10, 2005 (KR) ..... 10-2005-0020279

(51) Int. Cl.
*F21V 15/00* (2006.01)

(52) U.S. Cl. ..... 362/374; 362/375

(58) Field of Classification Search ..... 362/374, 362/375, 410, 362

See application file for complete search history.

(56) References Cited

U.S. PATENT DOCUMENTS

| | | | | |
|---|---|---|---|---|
| 3,755,665 | A * | 8/1973 | Grindle | 362/310 |
| 3,983,387 | A * | 9/1976 | Van Steenhoven et al. | 362/375 |
| 4,434,456 | A * | 2/1984 | Taylor | 362/374 |
| 6,419,378 | B1 * | 7/2002 | Wedell et al. | 362/431 |

FOREIGN PATENT DOCUMENTS

| | | |
|---|---|---|
| JP | 10-3814 A | 1/1998 |
| KR | 10-2005-0004346 A | 1/2005 |

* cited by examiner

*Primary Examiner*—Laura Tso
(74) *Attorney, Agent, or Firm*—Birch, Stewart, Kolasch & Birch, LLP

(57) ABSTRACT

An open/shut structure for a street lamp with plasma lighting system, comprising: a body having a fixed plasma lighting system; a cover that is installed to be removable from said body in order to be shielded from the outside by accommodating said plasma lighting system in said body; and an open/shut unit capable of opening and closing said cover according to the lengthwise direction of said body.

9 Claims, 5 Drawing Sheets

OPEN/SHUT STRUCTURE FOR STREET LAMP WITH PLASMA LIGHTING SYSTEM

BACKGROUND OF THE INVENTION

1. Field of the Invention

The present invention to an open/shut structure for a street lamp with plasma lighting system, and more particularly, to an open/shut structure for a street lamp with plasma lighting system (i.e., an induction lamp type street light) having a cover that can be opened widely to allow easier repair or maintenance.

2. Description of the Related Art

In general, a plasma lighting system (i.e., an induction lamp) is a device capable of allowing a metal chemical compound to continuously emitting light when electromagnetic waves generated by a magnetron changes the buffer gas within the bulb into the plasma state, to thus provide superior light intensity without the use of electrodes.

Such plasma lighting systems are recently being used much more commonly, because they can be easily installed at various locations where lighting is necessary. Due to their longevity and excellent lighting effects compared to incandescence lights or fluorescent lights, plasma lighting systems are used in commercial buildings (e.g., factories, office buildings, etc.) and in residential buildings (e.g., houses, apartments, etc.), and are used for street lamps (street lights) located along highways and small roads.

However, there are difficulties in performing repair and maintenance of plasma lighting system street lamps. Due to the height of street lamps and their location at or near busy roads and highways, workers who need to perform repair and maintenance thereon are exposed to dangerous situations. Another concern is that many street lamps along a busy highway may all need their bulbs to be replaced periodically, and thus any obstruction of traffic during such repair and maintenance should be minimized. As such, there is a need to provide a plasma lighting system street lamp with an improved structure that allows repair and maintenance to be performed more quickly and safely.

BREIF DESCRIPTION OF THE INVENTION

To achieve such purpose of the present invention, an open/shut structure for street lamp with plasma lighting system, comprising: a body having a fixed plasma lighting system; a cover that is installed to be removable from said body in order to be shielded from the outside by accommodating said plasma lighting system to said body; and an open/shut unit capable of opening and closing said cover according to the length's direction of said body is provided. This improved structure allows repair and maintenance to be performed more quickly and safely.

DETAILED DESCRIPTION OF THE INVENTION

Hereinafter, a cover for an induction lamp type street lamp (i.e., an open/close structure for the street lamp with plasma lighting system) is to be described in detail based on some exemplary embodiments illustrated in the attached drawings.

Figure 1:
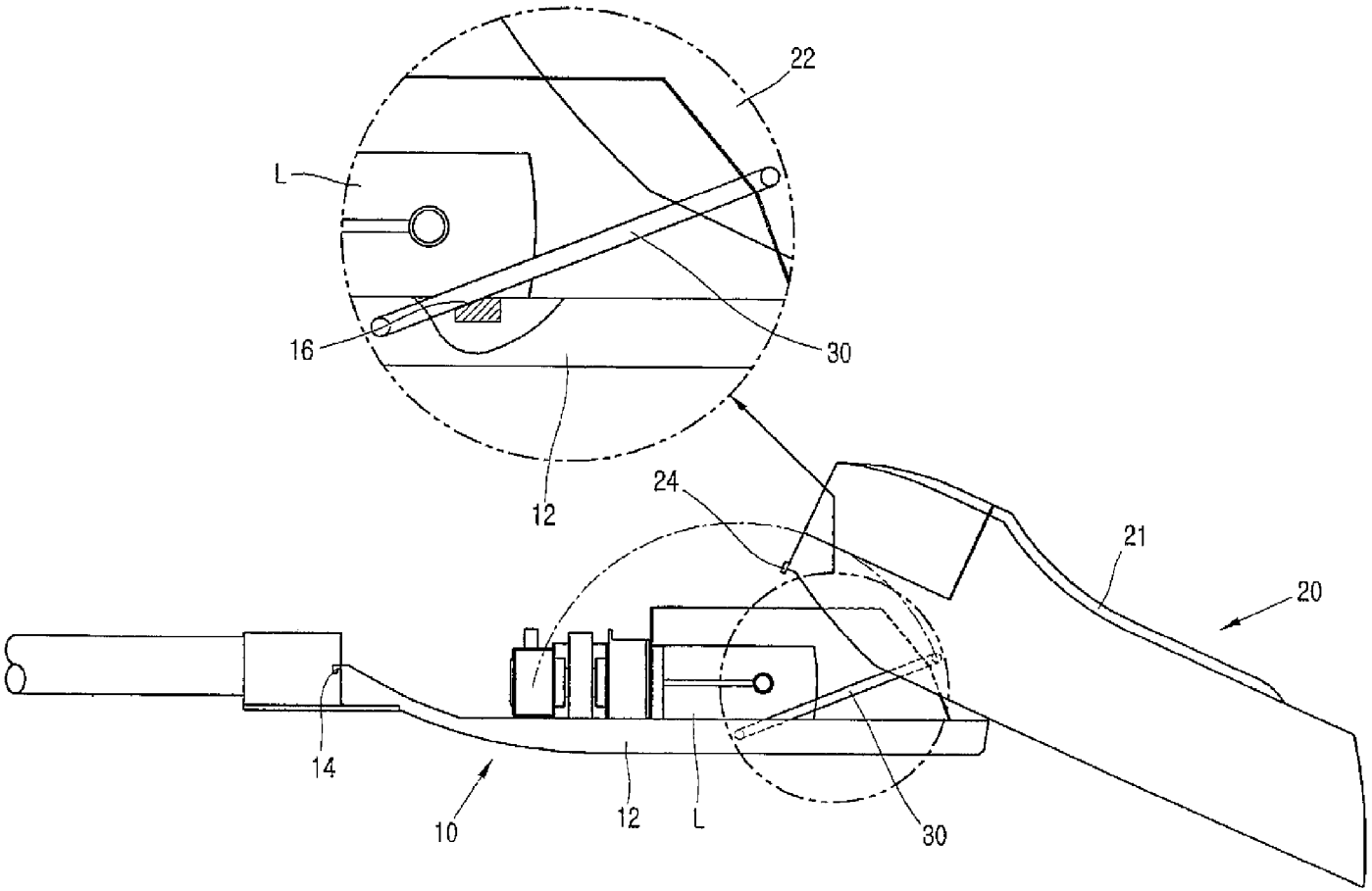
FIG. 1 is a side view that illustrates an open state of an exemplary cover of a street lamp with plasma lighting system according to a first embodiment of the present invention.
Figure 2:
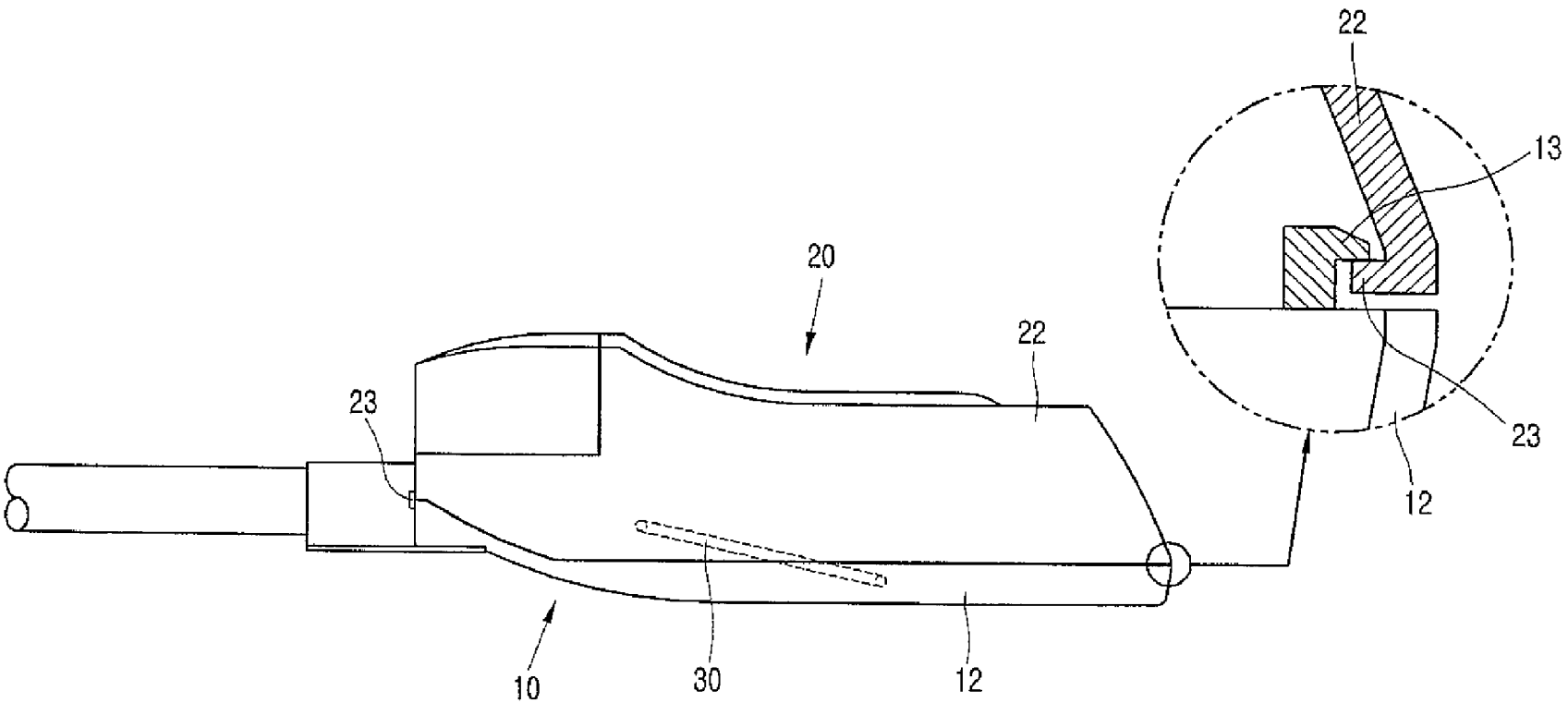
FIG. 2 is a side view that illustrates a closed state of an exemplary cover of the street lamp with plasma lighting system according to the first embodiment of the present invention.
Figure 3:
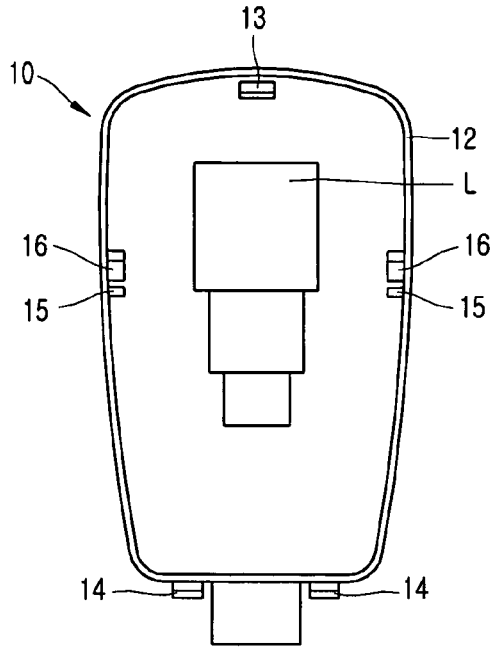
FIG. 3 is a planar view that illustrates a structure of an exemplary body of the street lamp with plasma lighting system of the present invention.
Figure 4:
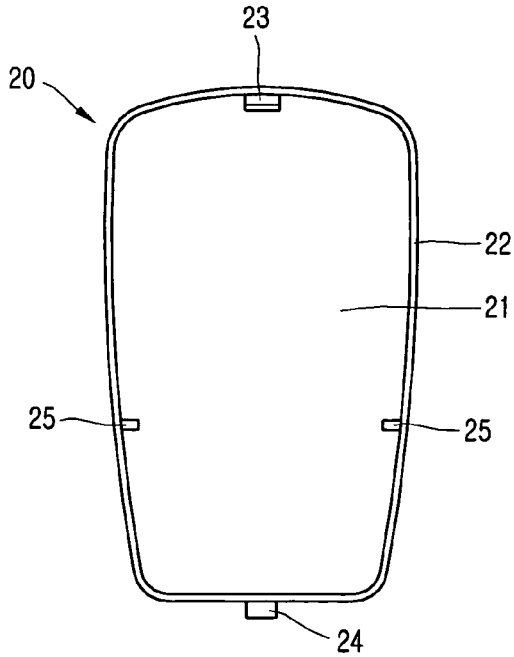
FIG. 4 is a rear view that illustrates a structure of an exemplary cover of the street lamp with plasma lighting system of the present invention.
Figure 5:
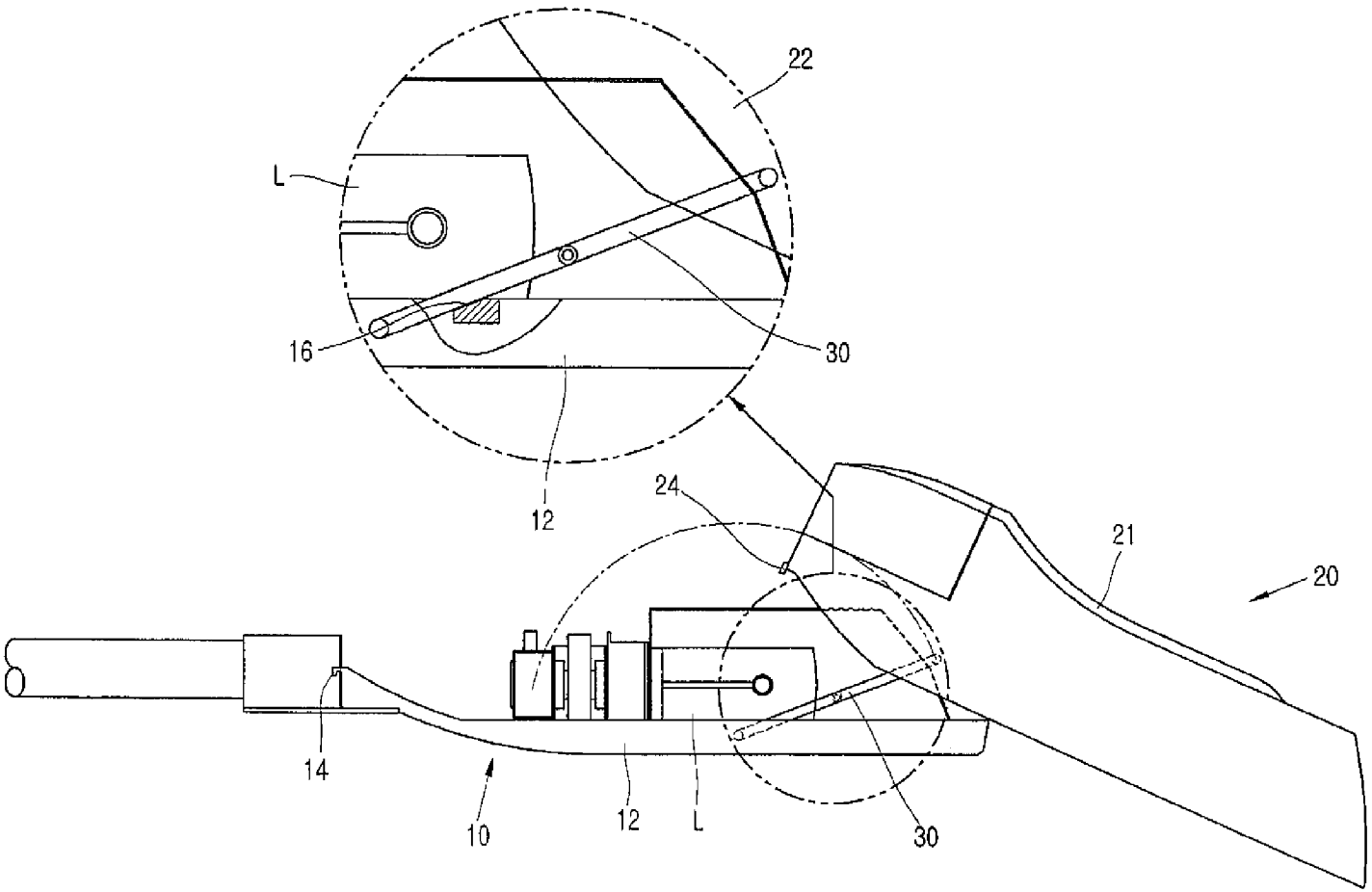
FIG. 5 is a side view that illustrates an exemplary structure of the street lamp with plasma lighting system according to a second embodiment of the present invention.
Figure 6:
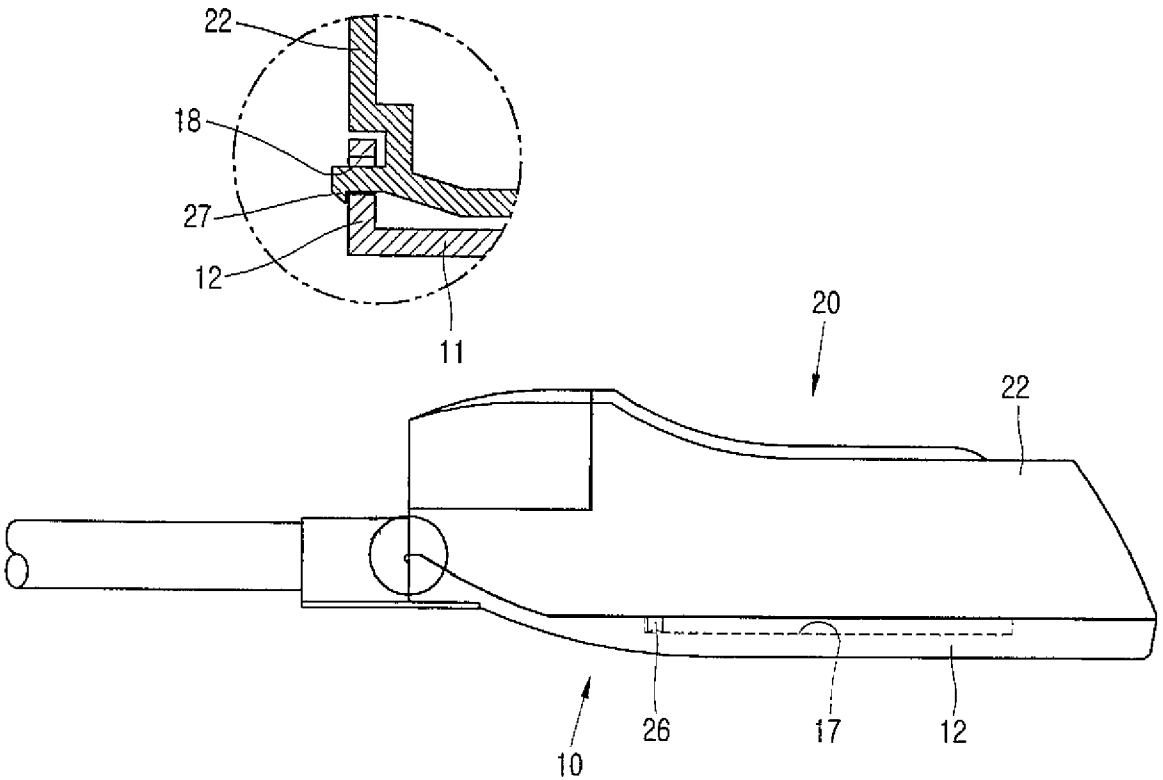
FIG. 6 is a side view that illustrates an exemplary structure of the street lamp with plasma lighting system according to a third embodiment of the present invention.

FIG. 1 is a side view that illustrates an open state of an exemplary cover of a street lamp with plasma lighting system according to a first embodiment of the present invention, FIG. 2 is a side view that illustrates a closed state of the exemplary cover of the street lamp with plasma lighting system according to the first embodiment of the present invention, FIG. 3 is a planar view that illustrates an exemplary structure of a body of the street lamp with plasma lighting system of the present invention, FIG. 4 is a rear view that illustrates an exemplary structure of a cover of the street lamp with plasma lighting system of the present invention, FIG. 5 is a side view that illustrates an exemplary structure of the street lamp with plasma lighting system according to a second embodiment of the present invention and FIG. 6 is a side view that illustrates an exemplary structure of the street lamp with plasma lighting system according to a third embodiment of the present invention.

As illustrated in the above-mentioned drawings, the street lamp with plasma lighting system according to the present invention comprises a body 10 having an induction lamp (L) installed therein, a cover 20 that is installed to be removable from the body 10 while accommodating the induction lamp (L) within the body 10 and providing shielding thereof, and an open/close unit capable of opening and closing the cover 20 along the lengthwise direction of the body 10.

As illustrated in FIG. 3, a body 10 comprises a panel type lower surface section 11 having a certain area capable of accommodating the induction lamp (L), a first side section 12 formed to protrude at a certain height in the thickness direction of the lower surface section 11 at the edge section thereof, a body side hook projection 13 formed at one end of the lower surface section 11 and that is engaged and combined with a cover side hook projection 23 of the cover 23, and a locking projection 14 that is securely fixed and engaged with the other end of the lower surface section 11 upon being clipped by a clip 24 of the cover 20.

Also, each opposing side of the body 10 has a hinge projection 15 that is formed to protrude at a certain length in the direction of the panel surface of the lower surface section 11, to act as a center of rotation for a link member 30 that receives the hinge projection 15 in a hinge hole (not marked) thereof. Each opposing side of the body 10 also has a link catching end 16 formed as a depressed portion (e.g., an engraved fan-shape) at one side of the first side section 12 with the hinge projection 15 at its center.

As illustrated in FIG. 4, the cover 20 comprises an upper surface section 21 corresponding to the lower surface section 11, a second side surface section 22 contacting with the first side surface section 12 by being formed at a certain height in the direction of the thickness of the upper surface section 21 at the edge section thereof, a cover side hook projection 23 that engages with the body side hook projection 13 by being formed to protrude from one end of the second side surface section 22, and a clip 24 that is formed at the other end of the second side surface section 22 to be fixed and engaged with the locking projection 14 of the body 10.

Further, a hinge projection 25 formed at both sides of the inner surface of the cover 20, constitutes a center of rotation upon insertion into the hinge hole (not marked) of the other end of a link member 30 (to be described hereafter) when the cover 20 is opened.

As illustrated in FIGS. 1 and 2, the link member 30 may be a single link member with hinge holes at both ends, or may be multiple link members 30 that may be folded at their center portions, as illustrated in the second embodiment of FIG. 5 of the present invention.

Here, the single link 30 should preferably be formed to have a length that allows complete exposure of the induction lamp (L) during the open state of the cover. Further, the single link 30 may forms a sliding groove at the end so that the hinge projection 25 of the cover section can be opened and closed by sliding to the length's direction of the single link 30.

The induction lamp (plasma lighting system) street light of the above-described structure may operate in the following manner.

As could be understood from the Figures, when the cover 20 is locked, both ends of the single link 30 rotate in the counterclockwise direction about the hinge projection 15, 25 of the body 10 with the cover 20 at the center, and the cover 20 may be placed on the upper surface 13 of the body 10. Here, after the hook projection 23 of the cover 20 is engaged with the hook projection 13 of the body 10, the locking projection 14 of the body 10 can be clipped and fixed by the clip 24 of the cover 20.

Thereafter, when the cover 20 is opened, both ends of the single link 30 also rotate in the clockwise direction about the body 10 and the hinge projection 15, 25 of the cover 20 at the center, and the cover 20 can be move away from the upper surface of the body 10. Here, due to the link catching end 16 being formed at both side surfaces of the body 10, the single link 30 gets caught by the link catching end 16 to restrict its rotation and thus can support the opened state of the cover 20.

FIG. 6 is an exemplary structure of the street lamp with plasma lighting system according to the third embodiment of the present invention. Certain parts being similar to those in the related art construction are labeled with same reference numerals, and thus a detailed description with respect to these will be omitted to prevent the present features from being obscured.

As shown in FIG. 6, the induction lamp (L) street light may comprise: a body 10 with an induction lamp installed therein; a cover 20 that is installed to be removable from the body 10 while accommodating the induction lamp (L) within the body 10 and providing shielding thereof, a slide groove 17 formed at one surface among the contacting surfaces of the body 10 and the cover 20; and a slide projection 26 engaged to the slide groove 17 to be capable of sliding thereof.

To maintain the closed state, an inserted hole 18 penetrates one surface among the contacting surfaces of the body 10 and the cover 20, and another surface of the body 10 and the cover 20 has a hook projection 27 that can be insert into and engage with the inserted hole 18.

The street lamp with plasma lighting system of the above-mentioned present invention operates in the following manner.

When the cover 20 is to be locked, it may be pushed up according to the lengthwise direction of the body 10, the slide projection 26 is securely received and moves to the upper side along the slide groove 17. As the slide motion is proceeds, the closed state of the cover 20 is maintained since the hook projection 27 contacts with, inserts into and engages with the inserting hole 18.

When the cover 20 is to be opened, it may be pushed down according to the lengthwise direction of the body 10, the hook projection 27 escapes from the inserting hole 18, and as the slide projection 26 that is securely received and moves to the lower side according to the slide groove 17, the opened state of the cover 20 is maintained by being in contact with one end of the slide groove 17.

According to such construction, the time it takes to open and close the cover of the induction type street light (i.e., a street lamp with plasma lighting system) may be reduced when compared to the related art structure. Thus, repair and maintenance workers may be better protected from the dangers of accidents because the overall time required to perform repairs and maintenance can be reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An open/shut structure for a street lamp with plasma lighting system, comprising:

a body having a fixed plasma lighting system;

a cover that is installed to be removable from said body; and an open/shut unit capable of opening and closing said cover according to the lengthwise direction of said body, wherein the open/close unit has a link member each end of which is engaged with the body and cover, respectively, and wherein the link member is capable of rotating, without sliding, at the engaged portion of the link member and the body, and the engaged portion of the link member and the cover, respectively.

2. The structure according to claim 1, wherein a locking unit capable of maintaining the closed state is formed at said body and cover.

3. The structure according to claim 1, wherein both ends of said open/close unit have a link member that is engaged with the body and the cover, for following rotation thereof and is folded or unfolded at a center thereof.

4. The structure according to claim 2, wherein said locking unit comprises:

a plurality of hook projections that are mutually supported by being formed at one side of said cover corresponding to one side of said body in order to prevent the moving of said cover when said cover encloses said body.

5. The structure according to claim 1, further comprising:

a link catching end is formed at one side among said body or cover to restrict the rotation angle of said link member.

6. The structure according to claim 5, wherein said link catching end is formed at the location where the plasma lighting system may be completely exposed to the outside of said body when said cover is opened.

7. A street lamp with plasma lighting system, comprising:

a body with a plasma lighting system;

a cover that is installed to be removable from the body;

one surface among the contacting surface of the body and the cover having a slide groove formed thereat; and a slide projection engaged with the slide groove to be capable of sliding, without rotation, therein.

8. The structure according to claim 7, wherein said body and cover comprise a locking unit capable of maintaining a closed state.

9. The structure according to claim 8, wherein one surface among the contacting surfaces of said body and said cover has an insertion hole formed therethrough, and a hook projection that is inserted into and engaged with the inserted hole is projected to the other surface of the body and the cover.

* * * * *